US009492723B1

(12) United States Patent
McCampbell

(10) Patent No.: US 9,492,723 B1
(45) Date of Patent: Nov. 15, 2016

(54) REPLICABLE POCKETS

(71) Applicant: String King Lacrosse LLC, Los Angeles, CA (US)

(72) Inventor: Jake McCampbell, Los Angeles, CA (US)

(73) Assignee: STRING KING LACROSSE LLC, Los Angeles, CA (US)

( * ) Notice: Subject to any disclaimer, the term of this patent is extended or adjusted under 35 U.S.C. 154(b) by 0 days.

(21) Appl. No.: 14/276,216

(22) Filed: May 13, 2014

Related U.S. Application Data

(60) Provisional application No. 61/837,425, filed on Jun. 20, 2013.

(51) Int. Cl.
*A63B 59/02* (2006.01)
*A63B 65/12* (2006.01)

(52) U.S. Cl.
CPC ..... *A63B 59/02* (2013.01); *A63B 2243/005* (2013.01)

(58) Field of Classification Search
CPC ..... A63B 69/00; A63B 59/20; A63B 65/12
USPC ..... 473/505, 510, 512, 513
See application file for complete search history.

(56) References Cited

U.S. PATENT DOCUMENTS 975,193 A * 11/1910 D'Abreu ..... A63B 67/083 473/509
1,459,389 A * 6/1923 Brown ..... A63B 47/02 124/5
4,153,251 A * 5/1979 Pond ..... A63B 59/02 473/513
5,178,397 A * 1/1993 Brine, Jr. ..... A63B 59/02 473/513
5,269,532 A * 12/1993 Tucker ..... A63B 59/02 473/513
6,520,875 B1 * 2/2003 Crawford ..... A63B 59/02 473/513
2002/0173389 A1 * 11/2002 Morrow ..... A63B 59/02 473/513
2006/0046876 A1 * 3/2006 Tucker, Jr. ..... A63B 59/02 473/513
2006/0258488 A1 * 11/2006 Lamson ..... A63B 59/02 473/513
2007/0054760 A1 * 3/2007 Gait ..... A63B 59/02 473/513
2008/0268987 A1 * 10/2008 Lignelli ..... A63B 59/02 473/513
2014/0349788 A1 * 11/2014 Vajda ..... A63B 59/02 473/513
2016/0101333 A1 * 4/2016 McCampbell ..... A63B 59/20 473/513

OTHER PUBLICATIONS

Webpage download, stringkinglacrosse2013, 2013, //web.archive.org/web/20130419121410/http:/stringkinglacrosse.com/?,15 pages.*
Product Brochure, Ehwha Stenter, 2010, 69 pages.*

* cited by examiner

*Primary Examiner* — Gene Kim
*Assistant Examiner* — Michael Chambers
(74) *Attorney, Agent, or Firm* — Gesmer Updegrove LLP

(57) ABSTRACT

A lacrosse stick is provided that includes a lacrosse head providing a frame for holding a ball. A V-Shaped pocket is coupled to the lacrosse head that defines a pocket region for holding the ball. The V-Shaped pocket includes a mesh structure having an inelastic knitting pattern and consistent mesh diamond length creating a stable pocket channel and depth.

13 Claims, 5 Drawing Sheets

REPLICABLE POCKETS

PRIORITY INFORMATION

This application claims priority from provisional application Ser. No. 61/837,425 filed Jun. 20, 2014, which is incorporated herein by reference in its entirety.

BACKGROUND OF THE INVENTION

The invention is related to the field of lacrosse sticks, and in particular a lacrosse stick having a replicable pocket.

Lacrosse pocket is the combination of the lacrosse mesh and how it is attached to the lacrosse head. The lacrosse mesh companies sold their lacrosse mesh, and then it was up to the lacrosse stick stringer (usually the customer or retail store employee) to decide how to attach the mesh to the head in order to create the pocket.

Typically lacrosse players are always trying to improve their lacrosse pocket, so every time they string their pocket they would change some aspects of the stringing to make it better. So not many lacrosse players would string two pieces of mesh into the same head in the same exact way. This is one reason why many lacrosse players did not notice the diamond size variation in the past. Also, because there are over 100 different lacrosse heads and variety number of ways to attach the lacrosse mesh to the lacrosse head to form the lacrosse pocket it was very reasonable to not control the lacrosse mesh diamond length precisely. This is because different mesh diamond lengths will be more desirable for different heads and different pocket shapes.

SUMMARY OF THE INVENTION

According to one aspect of the invention, there is provided a lacrosse stick. The lacrosse stick includes a lacrosse head that provides a frame for holding a ball. A V-Shaped pocket is coupled to the lacrosse head that defines a pocket region for holding the ball. The V-Shaped pocket includes a mesh structure having an inelastic knitting pattern and consistent mesh diamond length creating a stable pocket channel and depth.

According to another aspect of the invention, there is provided a method of forming a lacrosse stick. The method includes providing a lacrosse head that provides a frame for holding a ball. Moreover, the method includes forming a V-Shaped pocket coupled to the lacrosse head that defines a pocket region for holding the ball. The V-Shaped pocket includes a mesh structure having an inelastic knitting pattern and consistent mesh diamond length creating a stable pocket channel and depth.

DETAILED DESCRIPTION OF THE INVENTION

The invention provides a novel technique in producing high lacrosse heads and more importantly to make those lacrosse pockets replicable. In order to do this one has to make higher performing mesh, make more consistent mesh, precisely control the mesh diamond length, precisely control the mesh yarn shrinkage, find the best combination of mesh diamond length and pocket (stringing) engineering, and also develop a new way of explaining how to replicate our pockets.

Figure 1:
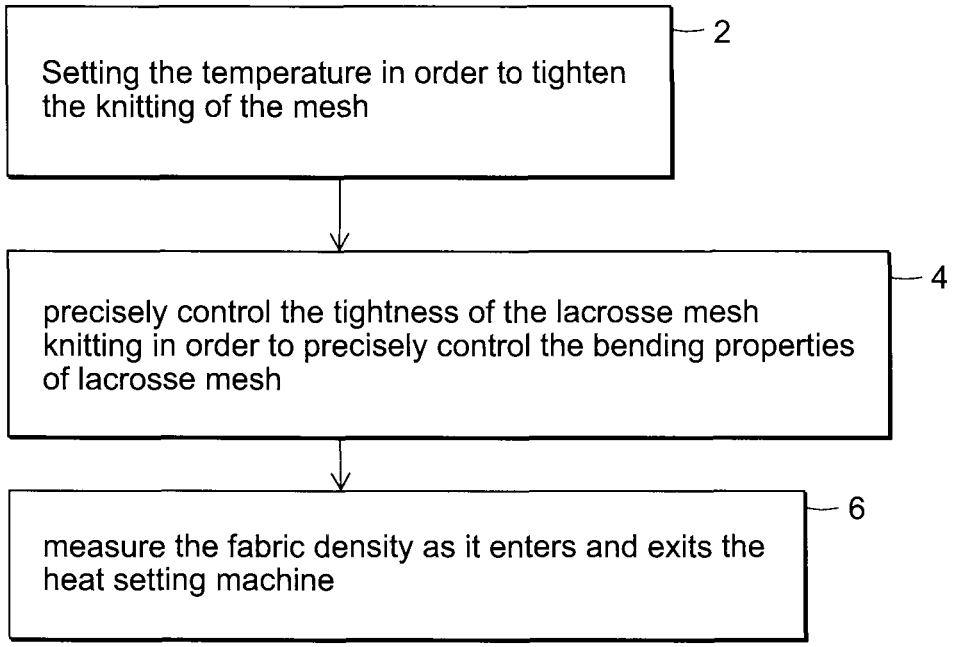
FIG. 1 is a process flow illustrating the process for developing the mesh used in accordance with the invention.

FIG. 1 a process flow illustrating the process for developing the mesh used in accordance with the invention. Lacrosse mesh should be heat set at temperatures between 50*C. and 400*C. in order to tighten the knitting of the mesh, as shown in step 2. The high temperatures cause the mesh yarns to shrink, thus creating tighter mesh knitting. Some of our competitors heat set their net, while others do not. Without proper heat setting, the lacrosse mesh will have loose knitting, which will cause the mesh to stretch/change form as the mesh is played with. This will create inconsistent performance. This can cause the lacrosse pocket to deepen and become illegal to play with.

If heat set properly, the mesh will have tighter knitting. Generally, tighter knitting will reduce the amount of stretch as the mesh is played with. However, if the knitting is too tight, then the mesh will become too stiff and will not bend in a manner that creates a good lacrosse pocket. It is very important to precisely control the tightness of the lacrosse mesh knitting in order to precisely control the bending properties of lacrosse mesh, as shown in step 4. The bending properties mainly affect the way that the pocket is shaped and deformed as the ball is cradled and thrown.

During this heat setting process the length of yarns within the mesh will shrink and the length of each diamond of mesh will also shrink. With current heat setting methods, the shrinkage of the length of the yarns and the shrinkage of the mesh diamonds are very difficult to control precisely. Before the invention, lacrosse mesh was typically heat set on Tenter Frames using overfeed control. The overfeed roller speeds are adjusted to adjust the amount of lengthwise tension in the mesh. While on the Tenter Frame, the mesh is put through an oven at high temperatures.

With this process, there are three main variables that effect the amount of yarn shrinkage and mesh diamond length shrinkage that ultimately control the resulting mesh diamond length and tightness of the knitted net. These three variables include heating temperature, heating duration, and the tension of the net controlled by the overfeed system. Each one of these three variables has a large impact on the shrinkage of the mesh yarns and the shrinkage of the mesh diamond length. It is very hard to control all three precisely. If each on their own can cause a x %, y %, z % standard deviation in mesh diamond length, then combined you will get a (x %^2+y %^2+z %^2)^(½) variation. (each on their own is hard to control accurately but all three together are extremely difficult to control accurately).

The most advanced overfeed machines use sensors to measure the fabric density as it enters and exits the heat setting machine, as shown in step 6. Depending on the fabric density, the overfeed roller speeds automatically adjust to correct the fabric density. Because lacrosse mesh comes in thin strips and has an open structure, the fabric density is hard to measure. This fabric density is even harder to measure if multiple strips of lacrosse mesh are fed through the machine at the same time. Also, lacrosse mesh does not typically have uniform density.

Figure 2:
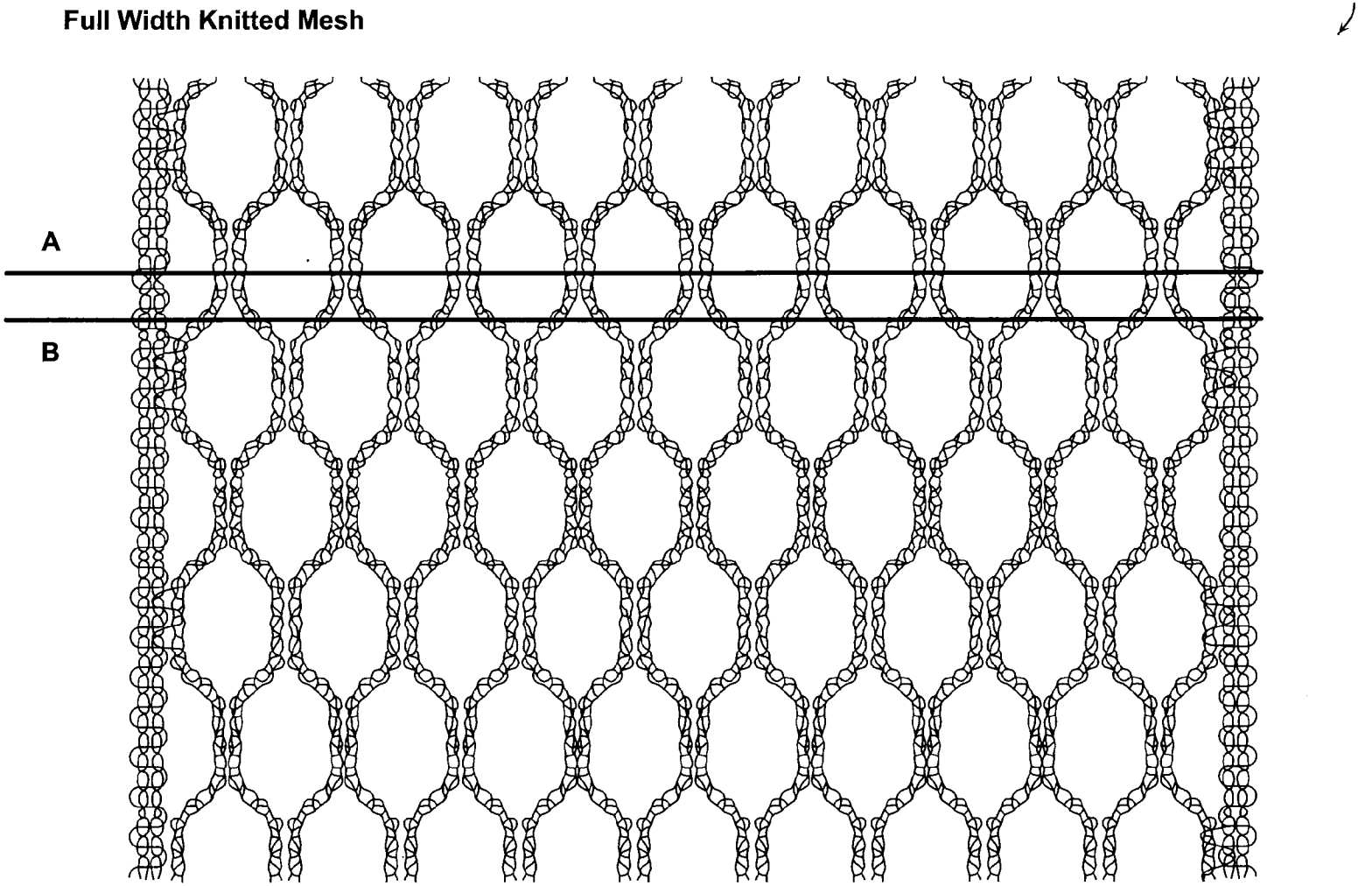
FIG. 2 is a schematic diagram illustrating the mesh used in accordance with the invention.

FIG. 2 is a schematic diagram illustrating the mesh 10 used in accordance with the invention. In particular, line A-B shows the fabric density across line A should be higher than the density across line B. This is because the weft yarns are longer at the connecting portions of the net. It is very hard to use fabric density sensors for lacrosse mesh because the mesh does not have a uniform density.

Also, the more precise the overfeed and heating systems are, the more expensive the machines are. (there may exist an overfeed system that is extremely precise and expensive that would work. So our method is much cheaper as well)

The invention provides a method of controlling the mesh diamond length to within 0.2% by fixing the mesh diamond length during the heat setting.

Figure 3:
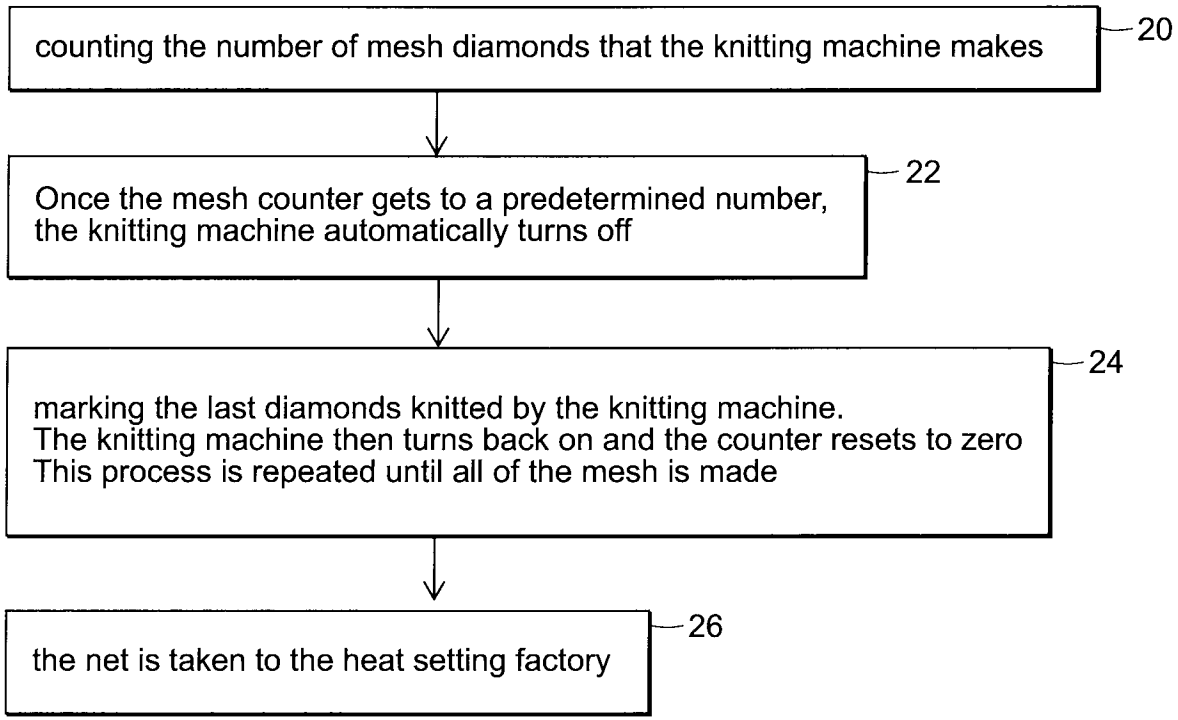
FIG. 3 is a process flow illustrating controlling the mesh diamond length in accordance with the invention.

FIG. 3 shows the process flow for controlling the mesh diamond length in accordance with the invention. While knitting the net we have an electric counter that counts the number of mesh diamonds that the knitting machine makes, as shown in step 20. Once the mesh counter gets to a predetermined number (say "A" mesh diamonds), the knitting machine automatically turns off, as shown in step 22. The knitting worker then marks the last diamonds knitted by the knitting machine. The knitting machine then turns back on and the counter resets to zero, as shown in step 24. This process is repeated until all of the mesh is made. Next, the net is taken to the heat setting factory, as shown in step 26. One can weave steel rods through the mesh diamonds that were marked during the knitting. One then places the net and steel rods into the heat setting machine. It is easiest to explain this method if you assume that one is just placing 1 length of net with steel rods on each end of the net (the steel rods are "A" mesh diamonds apart). One steel rod is placed at one end of the machine, while the other steel rod is placed at the other end of the machine. The steel rods are placed into the heat setting machine in a manner that allows us to change the distance "B" between the steel rods.

The mesh diamond length "C" can now be controlled using the following relationship:

Length per diamond=# of diamonds/length $C=A/B$.

Note that multiple pieces of net can be heat set at the same time using this method. Now that the strip of mesh is set to the correct length, the (oven, steamer, or anything that gets hot. One can currently use a steaming machine) is turned on. The heating machine is then set to a predetermined temperature for a predetermined amount of time. Variances in heat setting temperature and duration can no longer effect the mesh diamond length. This allows us to control the mesh diamond length as accurately as one wants. This accuracy is currently about 0.3%. When one does not need to worry about the mesh diamond length (which is most important), now one only needs to control two variables to accurately control the amount of shrinkage within the mesh yarns. Thus, the invention makes controlling the mesh diamond length and yarn shrinkage much more precise, easier to control, and cheaper to control. (now it just takes more workers to place the net in the heat setting machine).

The mesh diamond length is the most important aspect in creating reproducible lacrosse pockets. Before the invention, mesh diamond length was not controlled accurately so many companies would (and currently do) sell net with much variation in mesh diamond length. This variation is often somewhere between 3% and 5%. StringKing Lacrosse has created a new form of instructions that allow lacrosse players to duplicate its stringing methods exactly. By combining lacrosse mesh with diamond size accurate to within 0.3% and StringKing's new form of stringing instructions, for the first time lacrosse players are able to reproduce (replicate) lacrosse pockets exactly. This increases lacrosse players performance because they will now be able to consistently play with the same exact pocket. The inventive mesh diamond length is 2.90 cm+/−0.3%. It is extremely important that the mesh diamond length is accurately controlled within this range. The mesh diamond length should be measured when the mesh is uncoated, laid flat and straight. The mesh diamond size needs to be within this range because of the way that our lacrosse pockets are strung.

Figure 4:
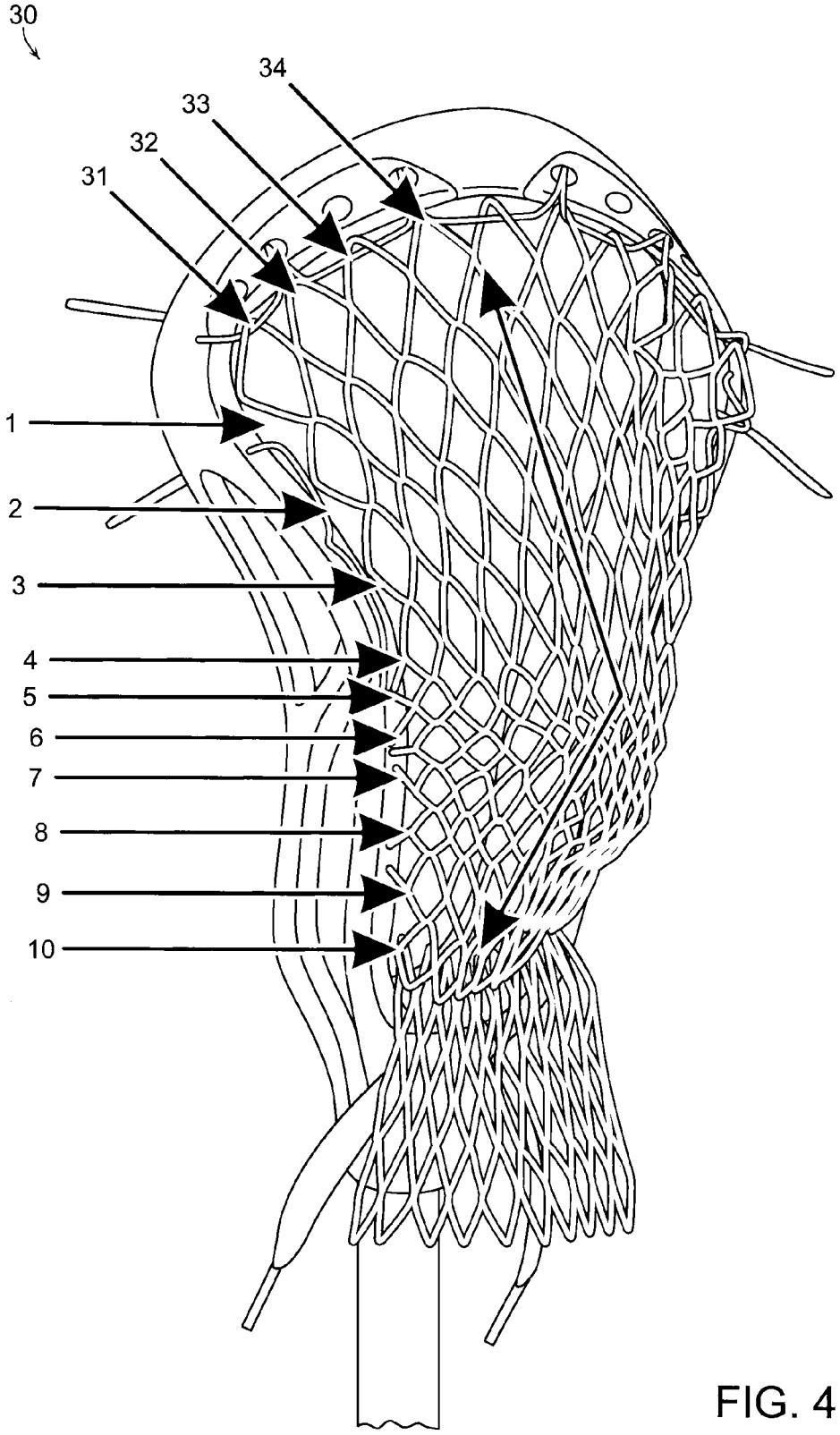
FIG. 4 is a schematic diagram illustrating the lacrosse pocket formed in accordance with the invention.

The inventive lacrosse pockets are strung so that the 4th diamond (elements 1-4) of mesh is pulled down about 45% of the distance from the top of the head to the bottom of the head, as shown in FIG. 4. Then 3 diamonds of mesh are used in close proximity (elements 5-7), and then 3 diamonds of mesh that are increasingly spread apart (elements 8-10). The mesh includes 9 diamond rows and 10 diamond rows. This is an industry standard. Most lacrosse heads today are designed for this structure of the net. Most lacrosse players use lacrosse mesh that are 9 and 10 diamond wide.

Current lacrosse heads are designed to string best with 9 diamonds across the top of the head. The placement of the 4th (elements 31-34) and 6th diamonds strung to the top of the head are very important for creating the proper channel shape. This is because these diamonds form a straight line to 4th sidewall diamonds (elements 1-4). When the 4th sidewall diamonds are pulled about 45% of the way down the head, the perfect v-channel shape is formed. If this pocket were more of a "U" shape, then the ball will sometimes get caught in the channel. If the channel were even more of a "V" shape, then the channel would be too tight for the ball to pass through.

Figure 5B:
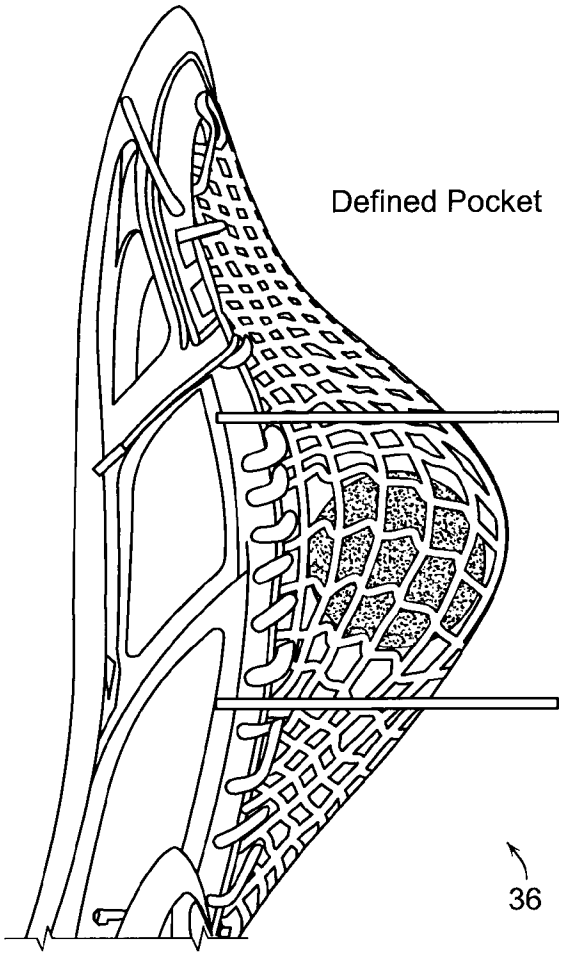
FIGS. 5A-5B are schematic diagrams illustrating the stringing technique used in accordance with the invention to produce the replicable pocket.
Figure 5A:
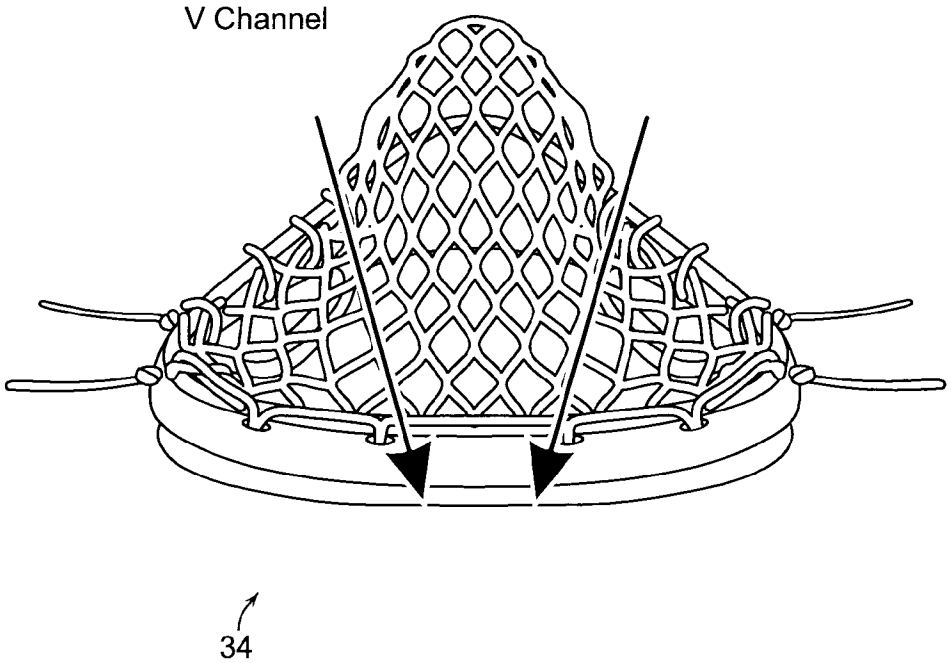

By combining this method of stringing, the precise mesh diamond size, and number of diamonds one can create a pocket with as shown in FIGS. 5A-5B. FIG. 5A shows a lacross head 34 positioned on a flat surface with its pocket arranged in a V-shape 38 while FIG. 5B shows a lacrosse head 36 positioned perpendicular a flat surface having a V-shaped pocket 40. A V-shape in the pocket guides a ball when throwing. This creates a higher level of accuracy. The V-shape also creates increased ball retention in the pocket. When cradling, the V-shape is tight enough to keep the ball from moving around in the pocket, however the V-shape is not too tight so it doesn't hinder throwing. A deeper pocket creates better ball retention. If the pocket is too deep, then it is ruled to be illegal for play. This combination of stringing pattern and mesh size creates a pocket that is as deep as possible without becoming illegal.

A defined pocket shape does not allow the ball to move around in the pocket. This increases consistency when throwing because the ball always starts at the same place in the pocket. Moreover, the pocket provides for a perfect launch angle that affects the amount of ball retention in the pocket. The trajectory of passes and shots, and the amount of speed in passes and shots are defined by the launch angle. This launch angle increases shot speed, ball retention, and creates a trajectory that lacrosse players like.

If the mesh diamond length is longer than 2.90 cm+0.3%, the pockets will become too deep and will become illegal for play. In addition, the pockets will not have the same shape definition. If the mesh diamond length is shorter than 2.90 cm−0.3%, the pocket channel will become too narrow. This will cause the ball to catch on the channel and sometimes throw with an unexpected downward trajectory. The pocket will become too shallow and will have inferior ball retention.

Others in the prior art use two patterns of weft yarns for each pillar of warp yarns. The two weft yarns in each pillar move in opposite directions from one another. This knitting pattern increases the breaking strength of the net, but gives the net increased elasticity in the horizontal direction. The increased elasticity is created in the sections of mesh where two pillars are connected by the weft yarns. This can be seen by stretching the net in the width direction with your hands and then letting go of the mesh. When you let go of the net, the net will generally spring back to a straight and upstretched form.

With an elastic knitting pattern (and elastic yarns and elastic coating), before throwing, the inward elastic force of the net will cause the mesh portion at the channel/throwing ramp to be tight. This tightness can be noticed best by looking at the horizontal distance between the mesh pillars. The tighter the mesh portion at the channel/throwing ramp is, the smaller the horizontal distance between mesh pillars at the channel/throwing ramp will be. While throwing, the players throwing motion will cause the ball to eventually reach the mesh portion at the channel/throwing ramp. As the ball reaches the mesh portion at the channel/throwing ramp, energy from the ball will be transferred into the mesh portion at the channel/throwing ramp and will force the mesh portion at the channel/throwing ramp to stretch.

The amount that the mesh portion at the channel/throwing ramp stretches will depend on the initial velocity and acceleration of the ball as it reaches said mesh portion at the channel/throwing ramp. Throwing mechanics, throwing angle, throwing strength, and more will affect the initial velocity and acceleration of the ball. If the ball is thrown slowly then the mesh portion at the channel/throwing ramp will stretch less, which will cause the channel of the pocket to be tighter and the throwing ramp to be steeper. If the channel of the pocket is too tight, then the ball will often become caught in the channel when throwing. This may cause the ball to uncontrollably throw downward. If the throwing ramp is steeper, then the ball will throw more downward. If the ball is thrown hard, then the mesh portion at the channel/throwing ramp will stretch more, which will cause the channel of the pocket to be looser and the throwing ramp to be more vertical. This will cause a higher trajectory when throwing.

The transfer of energy from the ball to the mesh portion at the channel/throwing ramp will also cause a decrease in throwing velocity. This will be detrimental to a lacrosse player's performance because he will not be able to shoot as hard. The invention uses a knitting pattern that include one pattern of weft yarns for each pillar. By using this knitting pattern one can effectively reduce the amount of horizontal elasticity in the mesh. This can be seen by stretching the net in the width direction with your hands and then letting go of the mesh. When one lets go of the mesh, the mesh will stay in the stretched position. Note the similar knitting pattern that is similar to our knitting pattern but not the same. This shape retention of the mesh is a desirable attribute for lacrosse pockets. The mesh portion at the channel/throwing ramp will now have a more consistent shape. The shape before throwing, during throwing, and after throwing will be more consistent. Less energy will be transferred from the ball to the mesh, so there will be less decrease in shot speed caused by the mesh. The throwing trajectory will also be less affected by throwing velocity or mechanics. This will lead to more consistent and more accurate passing and shooting. The channel will be the same shape for soft or hard passes so the ball will not get unexpected caught in the channel during throwing.

Others in the prior art have constructed lacrosse meshes with nylon yarns and polyester. The nylon yarns have a high breaking strength. Nylon also has high thermal shrinkage. This makes nylon an ideal choice for creating tightly knitted lacrosse mesh. However, nylon is a highly elastic material and is greatly affected by water. When lacrosse players use nylon lacrosse mesh for their lacrosse pocket, the lacrosse mesh will stretch "bag out" in the rain, and then shrivel up when left unused and/or left to dry.

This shape changing nature of nylon is highly undesirable in a lacrosse pocket. This is why our competitor's currently coat their nylon mesh in polyurethanes and/or a mixture of various waxes. The polyurethanes and/or various waxes will help to waterproof the nylon mesh. The various waxes will also cut down on the elasticity of the nylon mesh and help it hold its shape better. This is why wax mesh is quickly becoming one of the most important types of lacrosse mesh today. The elasticity of the nylon is also detrimental to the performance of lacrosse mesh/pockets when effects from weather conditions are negated.

The invention can use polyester instead of nylon to make the lacrosse mesh. Others have tried using polyester to make lacrosse mesh in the past. The problems that they encountered include polyester having a lower breaking strength than nylon. Many times polyester meshes would break while stringing or passing. Polyester has lower shrinkage than nylon. So it is hard to make tightly knitted lacrosse mesh with polyester. Typically, there is an inverse relationship between thermal shrinkage and breaking strength. This means that polyester yarns with a higher breaking strength will have a smaller thermal shrinkage. Higher heat setting temperatures and heat setting durations will be needed for higher breaking strength lacrosse mesh. The benefits of polyester include being much less elastic than nylon and is much less affected by water than nylon.

The invention uses a higher tenacity (higher breaking strength) polyester yarn that will not break like other polyester, but needs higher heat setting temperatures and times. Because of this, it is very important to have heat setting methods that are very easy to control. Also, the invention uses a thicker well yarn than any other. The well is the first yarn that will break so we use a thicker well yarn to make sure that it doesn't break. This is especially important because the knitting pattern only uses one well yarn for every pillar. The materials used by invention are inelastic and unaffected by water.

The inventive lacrosse mesh allows one to create a channeled lacrosse pocket that performs consistently. Other prior art meshes made it impossible to create a channeled lacrosse pocket that performed consistently. The reasons include elastic knitting pattern would cause the channel to contract when the ball was not in the channel. So when the ball entered the channel, the ball would sometimes get caught in that channel. Also, the amount that the channel expanded when the ball entered the channel depended on the speed of the ball entering the channel. Also, elastic nylon materials would cause the channel to frequently contract and expand. When the channel was in a contracted form, the ball would sometimes get caught in the channel. In the expanded form, the pocket was usually to deep and illegal. Also, the channel did not guide the ball. Moreover, inconsistent mesh diamond lengths produced in part by the channel would be too deep in certain areas while in others it would be too tight.

In contrast to the invention, the combination of inelastic knitting pattern, inelastic polyester materials, and consistent mesh diamond length create a consistent pocket channel and depth. In addition, the choice of mesh diamond length creates the perfect channel shape, pocket depth, and throwing ramp trajectory.

While others have also used the same diamond length size as us at some point because there is so much variation in their products. But not the combination of making everything inelastic (combining all of the elements listed previously) and also controlling the diamond size so precisely. No one has done the combination of even 2 or more of these before. These performance aspects include pocket depth, pocket channel, pocket definition, pocket ramp angle, and mesh bending rigidity for the perfect amount of shape retention. All of these elements are needed to create a lacrosse pocket that performs extremely well and consistently in all weather conditions.

The mesh structure described herein can include aramids fibers: such as Kevlar (Kevlar is a registered trademark of DuPont) or Twaron (Twaron is a registered product name of Teijin), high-modulus polyethylene (HMPE) fibers, carbon fibers, and high-modulus polypropylene fibers such as Innegra S fibers (Made by Innegra). The key here is these materials have high modulus providing the firm inelastic properties of the mesh, sufficient strength allowing for thin meshes to be used, and lightweight.

Although the present invention has been shown and described with respect to several preferred embodiments thereof, various changes, omissions and additions to the form and detail thereof, may be made therein, without departing from the spirit and scope of the invention.

What is claimed is:

1. A lacrosse stick comprising:

a lacrosse head that provides a frame for holding a ball; and a pocket structure coupled to the lacrosse head that defines a pocket region for holding the ball, the pocket structure includes a mesh structure having an inelastic knitting pattern and mesh diamond length creating a pocket channel and depth, the mesh structure comprises a plurality of diamond-shaped elements defining the mesh diamond length, wherein the mesh diamond length is sized to be within a range of 2.90 cm+/−0.3% of the mesh diamond length so as to allow the pocket structure to be replicable when in use and wherein the mesh structure comprises inelastic polyester materials.

2. The lacrosse stick of claim 1, wherein the mesh structure comprises rigidity for shape retention.

3. The lacrosse stick of claim 1, wherein the knitting pattern reduces the amount of horizontal elasticity in the mesh structure.

4. The lacrosse stick of claim 1, wherein the mesh structure stays in the stretched position when stretched in the width position.

5. The lacrosse stick of claim 1, wherein the pocket is formed when the mesh structure is strung in a selective fashion on the lacrosse head.

6. A method of forming the lacrosse stick of claim 1 comprising:

providing a lacrosse head that provides frame for holding a ball; and forming a V-Shaped pocket coupled to the lacrosse head that defines a pocket region for holding the ball, the V-Shaped pocket includes a mesh structure having an inelastic knitting pattern and consistent mesh diamond length creating a stable pocket channel and depth.

7. The method of claim 6, wherein the mesh diamond length creates the throwing ramp trajectory of the ball.

8. The method of claim 6, wherein the mesh structure comprises inelastic polyester materials.

9. The method of claim 6, wherein the mesh structure comprises rigidity for the perfect amount of shape retention.

10. The method of claim 6, wherein the V-shaped pocket performs consistently in all weather conditions.

11. The method of claim 6, wherein the knitting pattern reduces the amount of horizontal elasticity in the mesh structure.

12. The method of claim 6, wherein the mesh structure comprises stays in the stretched position when stretched in the width position.

13. The method of claim 6, wherein the V-shaped pocket is formed when the mesh structure is strung in a selective fashion on the lacrosse head.

* * * * *